US010219639B2

(12) United States Patent
Howard et al.

(10) Patent No.: US 10,219,639 B2
(45) Date of Patent: Mar. 5, 2019

(54) PRODUCT DISPLAY UNIT HAVING AN ADJUSTABLE WIDTH

(71) Applicant: Display Technologies, LLC, Lake Success, NY (US)

(72) Inventors: Andrew Howard, Mamaroneck, NY (US); Marty Lynn Illers, Yonkers, NY (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

(21) Appl. No.: 15/204,112

(22) Filed: Jul. 7, 2016

(65) Prior Publication Data

US 2017/0007040 A1 Jan. 12, 2017

Related U.S. Application Data

(60) Provisional application No. 62/189,426, filed on Jul. 7, 2015.

(51) Int. Cl.

| | |
|---|---|
| ***A47F 5/00*** | (2006.01) |
| ***A47F 1/12*** | (2006.01) |
| ***A47F 1/04*** | (2006.01) |

(52) U.S. Cl.

CPC ..... *A47F 5/005* (2013.01); *A47F 1/04* (2013.01); *A47F 1/125* (2013.01); *A47F 1/126* (2013.01)

(58) Field of Classification Search

CPC .... A47F 1/04; A47F 1/12; A47F 1/125; A47F 1/126; A47F 5/005; A47F 5/0093; A47F 5/0025

See application file for complete search history.

(56) References Cited

U.S. PATENT DOCUMENTS

| | | | | |
|---|---|---|---|---|
| 2,669,361 A | | 2/1954 | Just | |
| 3,868,021 A | * | 2/1975 | Heinrich | A47B 57/585 211/184 |
| 4,394,910 A | | 7/1983 | Miller | |
| 4,712,694 A | * | 12/1987 | Breslow | A47F 5/005 108/61 |

(Continued)

FOREIGN PATENT DOCUMENTS

| | | |
|---|---|---|
| DE | 10 2013 104045 B3 | 10/2014 |
| WO | 2002089104 A2 | 11/2002 |
| WO | 2014200759 A1 | 12/2014 |

OTHER PUBLICATIONS

International Search Report PCT/US16/41260 dated Sep. 29, 2016.

(Continued)

*Primary Examiner* — Kimberley S Wright

(74) *Attorney, Agent, or Firm* — Andrus Intellectual Property Law, LLP

(57) ABSTRACT

A product display unit includes a track, a first sidewall, a second sidewall, and a width adjustment feature. The track defines a longitudinal axis and is configured to support a plurality of products thereon. The first sidewall is disposed adjacent the track. The second sidewall is disposed adjacent the track. The width adjustment feature is disposed in mechanical cooperation with the first sidewall. The width adjustment feature enables a distance between the first sidewall and the second sidewall to be changed. The distance is perpendicular to the longitudinal axis.

19 Claims, 6 Drawing Sheets

(56) References Cited

U.S. PATENT DOCUMENTS 4,757,915 A * 7/1988 Albright ..... G07F 11/42 221/242
4,801,025 A 1/1989 Flum et al.
5,024,336 A * 6/1991 Spamer ..... F16B 12/10 211/153
5,450,968 A * 9/1995 Bustos ..... A47F 5/005 108/108
5,542,552 A * 8/1996 Yablans ..... A47F 1/126 211/43
5,562,217 A * 10/1996 Salveson ..... A47F 1/126 211/175
5,570,811 A * 11/1996 Wittern, Jr. ..... G07F 11/42 221/127
5,582,305 A * 12/1996 Howell, Sr. ..... A47F 5/0006 211/126.1
5,645,176 A * 7/1997 Jay ..... A47F 5/0043 211/59.2
5,695,076 A * 12/1997 Jay ..... A47F 1/12 211/183
5,971,173 A * 10/1999 Valiulis ..... A47F 5/005 211/184
6,047,647 A * 4/2000 Laraia, Jr. ..... A47B 57/58 108/61
6,082,557 A * 7/2000 Leahy ..... A47B 57/58 211/184
6,142,316 A * 11/2000 Harbour ..... A47F 1/12 211/59.2
6,533,131 B2 * 3/2003 Bada ..... A47B 57/583 211/184
6,739,461 B1 * 5/2004 Robinson ..... A47F 1/12 211/175
7,458,473 B1 12/2008 Mason
7,992,747 B2 8/2011 Bauer
8,038,018 B1 * 10/2011 Breitenbach ..... G07F 11/36 211/59.3
8,113,360 B2 * 2/2012 Olson ..... A47F 5/005 211/59.3
8,127,943 B2 * 3/2012 Takashima ..... A47F 1/126 211/59.3
8,162,154 B2 * 4/2012 Trulaske, Sr. ..... A47F 1/12 211/183
8,172,094 B2 * 5/2012 Meyer ..... A47F 1/126 211/134
8,662,325 B2 * 3/2014 Davis ..... A47B 57/585 211/151
9,117,346 B2 * 8/2015 Chen ..... G07F 11/38
9,642,475 B2 * 5/2017 Vogler ..... A47F 1/125
2002/0179553 A1 * 12/2002 Squitieri ..... A47F 5/005 211/59.2
2003/0010737 A1 * 1/2003 Lee ..... A47F 3/147 211/184
2003/0132182 A1 * 7/2003 Jay ..... A47B 96/021 211/175
2003/0141265 A1 * 7/2003 Jo ..... A47F 1/126 211/59.3
2003/0150829 A1 * 8/2003 Linden ..... A47F 5/005 211/126.1
2005/0139560 A1 6/2005 Whiteside et al.
2006/0237384 A1 * 10/2006 Neumann ..... A47F 1/12 211/184
2006/0260518 A1 * 11/2006 Josefsson ..... A47F 5/005 108/61
2007/0119799 A1 * 5/2007 Hanretty ..... A47F 1/04 211/59.2
2007/0175843 A1 * 8/2007 Kanasashi ..... A47F 1/12 211/94.01
2010/0032391 A1 2/2010 Schneider et al.
2010/0072149 A1 * 3/2010 Trulaske, Sr. ..... A47F 1/12 211/59.2
2010/0252519 A1 * 10/2010 Hanners ..... A47F 5/005 211/184
2011/0094980 A1 * 4/2011 Cousin ..... A47F 5/005 211/59.2
2011/0147323 A1 * 6/2011 Sainato ..... A47F 1/12 211/59.2
2012/0255922 A1 * 10/2012 Bryson ..... A47F 1/126 211/59.3
2013/0020270 A1 * 1/2013 Valiulis ..... A47F 5/005 211/59.2
2013/0213916 A1 * 8/2013 Leahy ..... A47F 5/005 211/151
2014/0144854 A1 * 5/2014 Burchell ..... A47F 1/125 211/59.3
2014/0151313 A1 * 6/2014 Breslow ..... A47F 1/04 211/59.3
2014/0175032 A1 * 6/2014 Chen ..... G07F 11/38 211/49.1
2014/0299560 A1 * 10/2014 Kim ..... A47F 1/126 211/59.2
2014/0360953 A1 * 12/2014 Pichel ..... A47F 1/04 211/59.3
2015/0359358 A1 * 12/2015 Miller, Jr. ..... A47F 5/005 211/59.2

OTHER PUBLICATIONS

Written Opinion of the International Searching Authority dated Sep. 29, 2016 issued in corresponding PCT Application No. PCT/US2016/41260.

Extended European Search Report for EP 16821952.5, dated Nov. 14, 2018.

* cited by examiner

PRODUCT DISPLAY UNIT HAVING AN ADJUSTABLE WIDTH

CROSS-REFERENCE TO RELATED APPLICATION

The present application claims priority to, and the benefit of, U.S. Provisional Patent Application Ser. No. 62/189,426 filed on Jul. 7, 2015, the entire contents of which being herein incorporated by reference in its entirety.

BACKGROUND

The present disclosure relates to a product display unit, and more particularly, to a product display unit having an adjustable width to increase the functionality of the product display unit.

Various types of product display units and merchandisers are commonly used in retail environments to display different types of products. As opposed to simply positioning products on shelves, product display units are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product display units facilitate the arrangement and upkeep of products, as the trailing products do not have to be manually moved toward the front of the shelf, for instance.

Additionally, in retail environments, for example, floor space, shelf space, and space in cold vaults is limited, and retailers typically attempt to maximize the amount of products they can store/display in their retail space. Further, retailers and other users of product display units often use product display units of different sizes to fit on a variety of types and sizes of shelves and cabinets, for example. Such users of product display units must typically stock a variety of sizes of display units to ensure they have enough product display units to accommodate displaying a variety of goods.

Accordingly, it is often desirable for retailers to display products in as many viewable and reachable places as possible, while still allowing the products to automatically advance toward the proximal portion of the shelf. It is also desirable for retailers to be able to use product display units to display a variety of sizes of products without the need to stock different sizes of product display units.

SUMMARY

The present disclosure relates to a product display unit. The product display unit includes a track, a first sidewall, a second sidewall, and a width adjustment feature. The track defines a longitudinal axis and is configured to support a plurality of products thereon. The first sidewall is disposed adjacent the track. The second sidewall is disposed adjacent the track. The width adjustment feature is disposed in mechanical cooperation with the first sidewall. The width adjustment feature enables a distance between the first sidewall and the second sidewall to change. The distance is perpendicular to the longitudinal axis.

In disclosed embodiments, the width adjustment feature may be free from contact with the track. It is further disclosed that the width adjustment feature may be affixed to the track.

It is also disclosed that the width adjustment feature may include a plurality of living hinges.

In disclosed embodiments, the distance may be adjustable between about 2.0 inches and about 3.5 inches.

It is further disclosed that the product display unit may include a base. The track may be positioned on the base. It is also disclosed that the first sidewall and the second sidewall may extend from the base.

The present disclosure also relates to a product display assembly. The product display assembly includes a first product display unit and a second product display unit. The first product display unit includes a track configured to support a plurality of products thereon, and a first sidewall disposed adjacent the track. The second product display unit includes a track, a first sidewall, and a width adjustment feature. The track defines a first longitudinal axis and is configured to support a plurality of products thereon. The first sidewall is disposed adjacent the track. The width adjustment feature is configured to change a distance between the first sidewall of the first product display unit and the first sidewall of the second product display unit. The distance is perpendicular to the longitudinal axis.

In disclosed embodiments, the width adjustment feature may be free from contact with the track of the second product display unit. It is also disclosed that the width adjustment feature may be affixed to the track of the second product display unit.

It is further disclosed that the width adjustment feature may include a plurality of living hinges.

In disclosed embodiments, the distance may be adjustable between about 2.0 inches and about 3.5 inches.

It is also disclosed that the second product display unit may include a base. The track of the second product display unit may be positioned on the base. It is further disclosed that the first sidewall of the second product display unit may extend from the base.

In disclosed embodiments, the product display unit may include a distal member disposed in mechanical cooperation with the first sidewall of the first product display unit and the first sidewall of the second product display unit. It is also disclosed that each of the first sidewall of the first product display unit and the first sidewall of the second product display unit may be slidable with respect to the distal member.

It is further disclosed that the first sidewall of the first product display unit may define a length along the longitudinal axis. The length of the first sidewall of the first product display unit may be adjustable.

BRIEF DESCRIPTION OF THE DRAWINGS

Embodiments of the present disclosure are described hereinbelow with reference to the drawings wherein.

DETAILED DESCRIPTION

Figure 1:
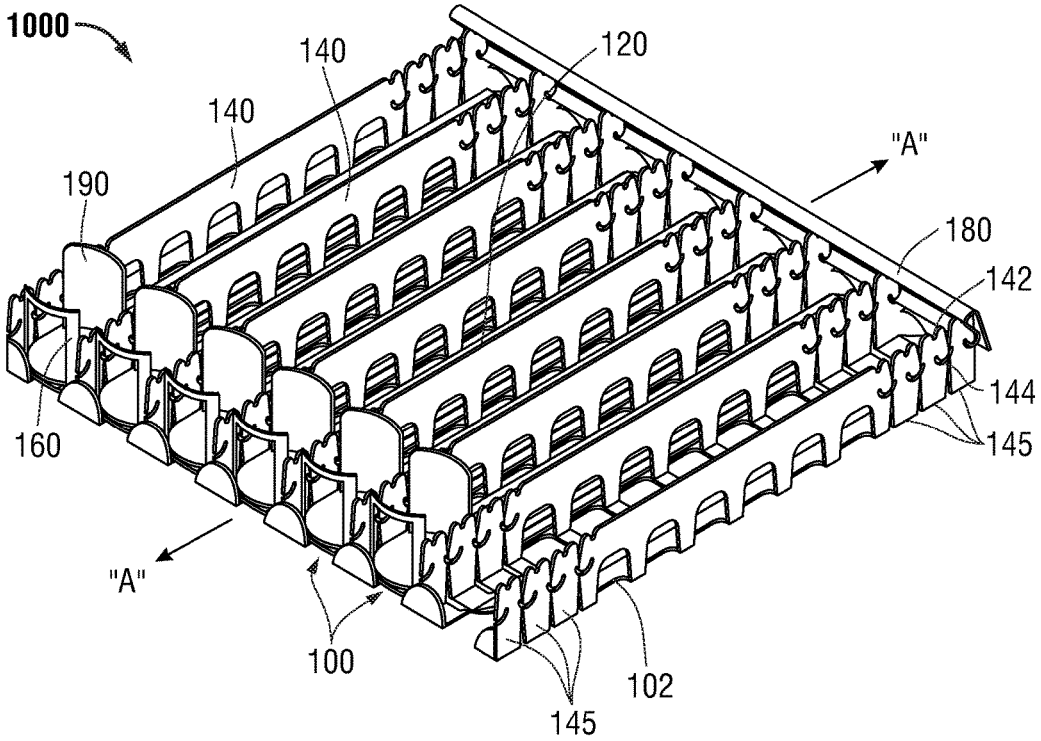
FIG. 1 is a perspective view of a product display assembly including a first width adjustment feature in accordance with the present disclosure.

Embodiments of the presently disclosed product display unit are now described in detail with reference to the drawings, in which like reference numerals designate identical or corresponding elements in each of the several views. As used herein the term "distal" refers to that portion of the product display unit, or component thereof, farther from a user (e.g., customer), while the term "proximal" refers to that portion of the product display unit, or component thereof, closer to the user.

Embodiments of a product display assembly are illustrated in FIGS. 1-10 and are generally referenced by numeral 1000. Product display assembly 1000 includes a plurality (e.g., seven) of adjacent product display units 100. In FIG. 1, each product display unit 100 includes a base 102, a bottom member 110, a track 120, sidewalls 140, and a proximal member 160. A distal member 180 is also included in the embodiment of FIGS. 1-6.

The track 120 includes a product-supporting surface and is configured to slidably support a plurality of products thereon. That is, products are slidable along the track 120. For example, gravity may urge products to slide along the track 120 in a distal-to-proximal direction. In such gravity feed arrangements, a distal portion of the track 120 is elevated with respect to a proximal portion of the track, such that gravity urges the products toward proximal member 160. Additionally, the track 120 defines a longitudinal axis "A-A."

In the embodiment illustrated in FIGS. 1-6, a pusher 190 is used to urge products proximally with respect to track 120. Here, either the distal or proximal portion of the track 120 may be elevated, or the track can be horizontal or level.

The sidewalls 140 are disposed at both lateral sides of the track 120 and are configured to help maintain products on the track 120. When a plurality of product display units 100 is positioned adjacent one another to form product display assembly 1000, it is envisioned that adjacent product display units 100 share common sidewalls 140. Alternatively, each product display unit 100 may include a pair of sidewalls 140 such that, when connected to another product display unit 100, the sidewalls 140 are in an abutting relationship.

The proximal member 160 is positioned adjacent the front or proximal portion of the track 120 and is configured to help maintain products on the track 120. More specifically, the proximal member 160 helps prevent a proximal-most product from falling proximally off of the track 120. Additionally, the proximal member 160 opposes the gravitational force and/or the force supplied by pusher 190. Further, while the illustrated embodiments include a certain type of proximal member 160, the present disclosure includes the use of any suitable type and number of proximal members 160 per product display unit 100.

Figure 2:
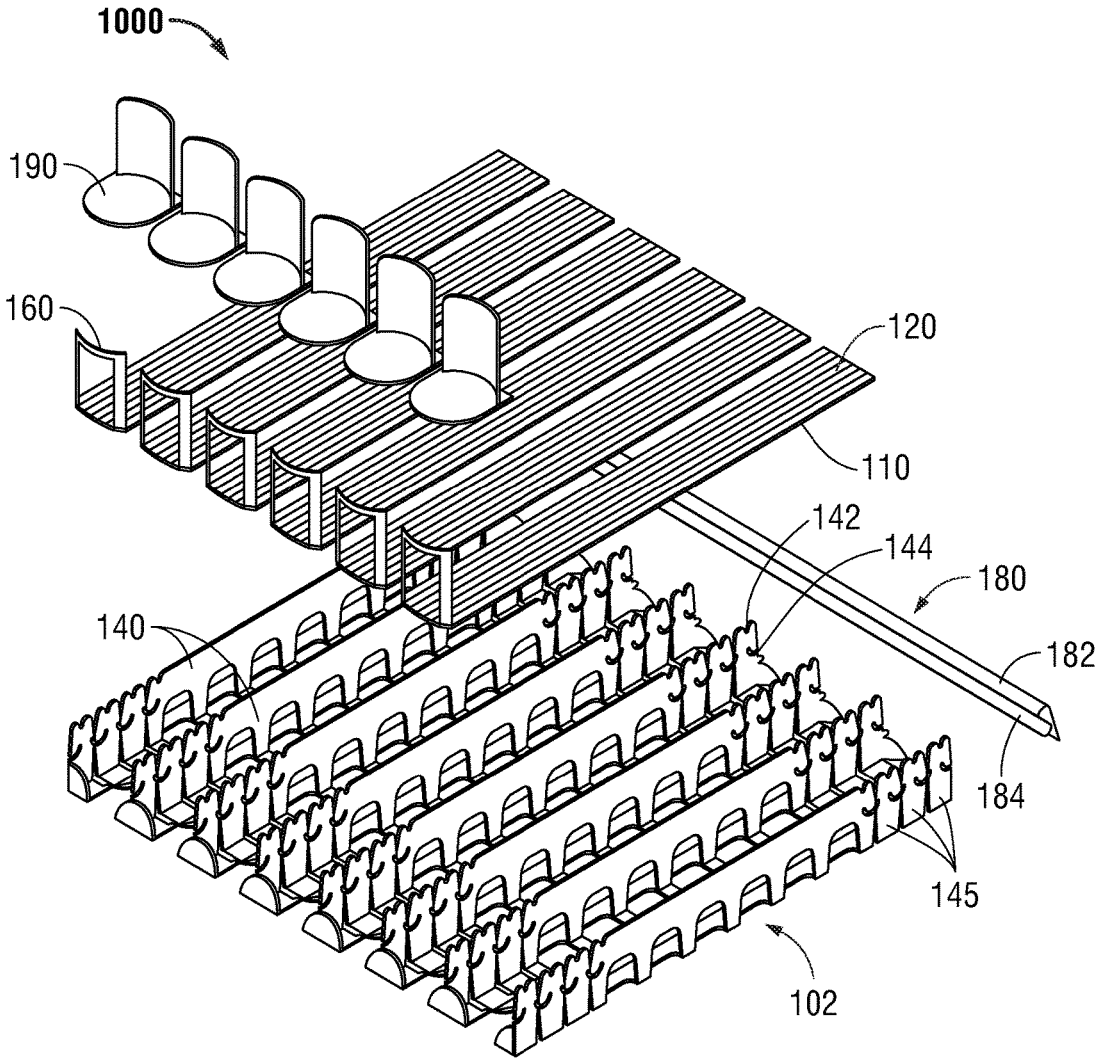
FIG. 2 is an assembly view of the product display assembly of FIG. 1.

The distal member 180 is configured to help maintain products "P" on track 120. More particularly, the distal member 180 is configured to help prevent a distal-most product from falling distally off of the track 120. It is envisioned that each product display unit 100 includes its own distal member 180. It is also disclosed that several adjacent product display units 100 (e.g., an entire product display assembly 1000) share a single distal member 180 (FIGS. 1 and 2).

Figure 3:
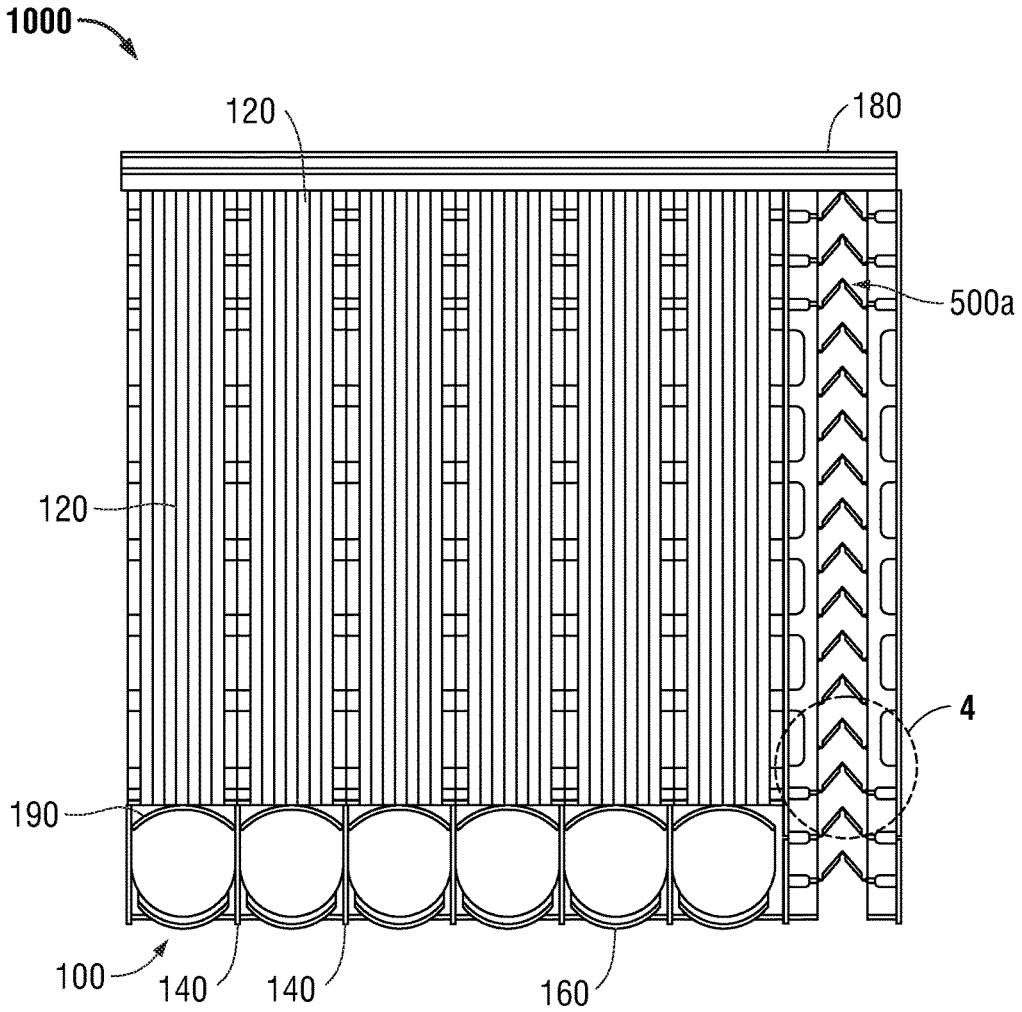
FIG. 3 is a top view of the product display assembly of FIG. 1.
Figure 4:
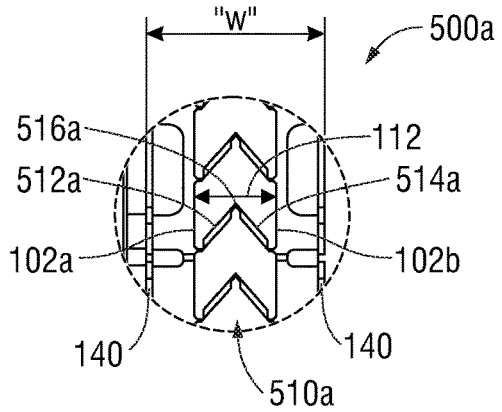
FIG. 4 is an enlarged view of the area of detail indicated in FIG. 3.
Figure 5:
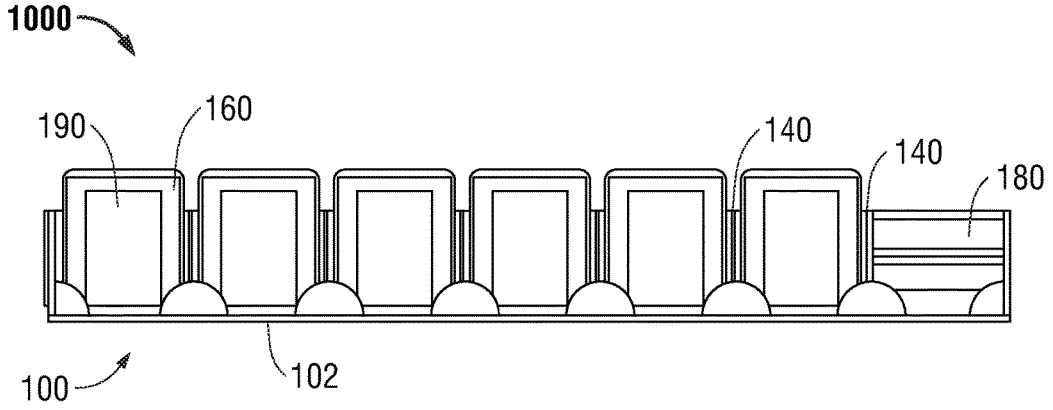
FIG. 5 is a front view of the product display assembly of FIG. 1.
Figure 6:
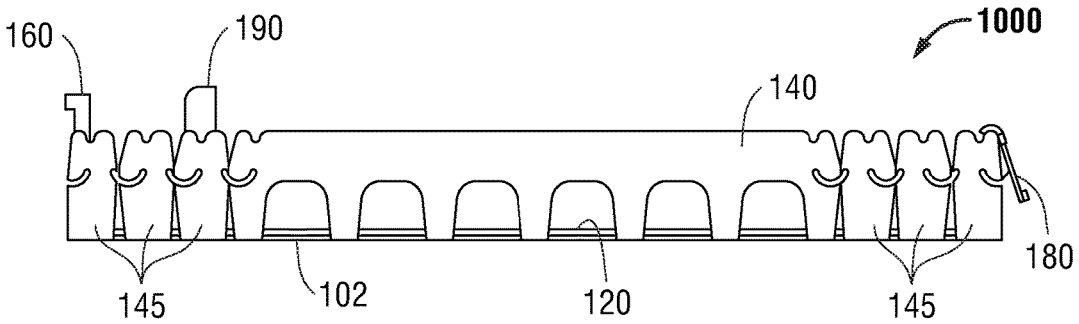
FIG. 6 is a side view of the product display assembly of FIG. 1.

The present disclosure also includes a width adjustment feature that is configured to change the width "w" between adjacent sidewalls 140. With reference to FIGS. 3 and 4, a first embodiment of width adjustment feature is shown and is indicated by reference character 500*a*. Here, width adjustment feature 500*a* includes a plurality of living hinges 510*a*, with each living hinge 510*a* spanning a gap 112 (FIG. 4) between adjacent portions of base 102. A first portion 512*a* of each living hinge 510*a* is mechanically engaged (e.g. affixed) to a first lateral portion 102*a* of base 102. A second portion 514*a* of each living hinge 510*a* is mechanically engaged (e.g., affixed) to a second lateral portion 102*b* of base 102. A central portion 516*a* of each living hinge 510*a* interconnects the first portion 512*a* and the second portion 514*a* and enables the first portion 512 and the second portion 514 and thus the respective lateral portions 102*a*, 102*b* of base 102 to flex or move with respect to each other.

In this embodiment, the sidewalls 140 are affixed to the base 102, thus the use of living hinges 510*a* enables the width "w" between adjacent sidewalls 140 to be changed between a first, small size where first portion 512*a* of living hinge 510*a* is relatively close to second portion 514*a* of living hinge 510*a*, and a second, large size where first portion 512*a* of living hinge 510*a* is relatively far from second portion 514*a* of living hinge 510*a*. Further, living hinge 510*a* allows an infinite amount of widths "w" between adjacent sidewalls 140 between the first, small size and the second, large size. It is envisioned that the width "w" between adjacent sidewalls 140 is adjustable from between about 2.0 inches (about 5.1 cm) to about 3.5 inches (about 8.9 cm). Accordingly, the product display unit 100 can accommodate a typical 12-ounce beverage container (e.g., a can), which is about 2.625 inches (about 6.73 cm) wide, and a typical 20-ounce beverage container (e.g., a bottle), which is about 2.875 inches (about 7.30 cm) wide.

To increase the width "w," a user may hold one sidewall 140 and move it laterally (or sideways) away from an adjacent sidewall 140. To decrease the width "w," a user may hold one sidewall 140 and move it laterally (or sideways) toward an adjacent sidewall 140.

To help guide and/or re-position the sidewalls 140, distal member 180 may be useful. With reference to FIGS. 1-3, distal member 180 includes an upper guide 182 and a lower guide 184 (FIG. 2). Upper guide 182 slidingly engages an upper surface/groove 142 at a distal end of each sidewall 140. Lower guide 184 slidingly engages a lower groove 144 at the distal end of each sidewall 140. As such, sidewalls 140 are laterally movable along distal member 180.

With continued reference to FIGS. 1-3, in this embodiment, bottom member 110 including track 120 is positionable onto base 102 of product display unit 100. It is envisioned that a width bottom member 110 is equal to or smaller than the first, small size of the width "w" between adjacent sidewalls 140.

While a particular number of living hinges 510*a* is shown in FIG. 3, it is envisioned that more or fewer living hinges 510*a* are used. Additionally, while living hinges 510*a* are only shown on a single product display unit 100, it is envisioned that any number of product display units 100 (e.g., all product display units 100) of product display assembly 1000 includes living hinges 510*a*.

With reference to FIGS. 7-10, a second embodiment of width adjustment feature is shown for use with product display assembly 1000 and is indicated by reference character 500*b*. Here, width adjustment feature 500*b* includes a plurality of hinge mechanisms 550*b* and a plurality of living hinges 560*b*. Hinge mechanisms 550*b* and living hinges 560*b* span a gap 121 between adjacent slats 122*a*, 122*b* of track 120.

A first portion 552*b* of each hinge mechanism 550*b* is mechanically engaged (e.g. affixed) to a first slat 122*a* of track 120. A second portion 554*b* of each hinge mechanism 550*b* is mechanically engaged (e.g., affixed) to a second slat 122*b* of track 120. Hinge mechanism 550*b* may also include a pin 556*b* extending through or adjacent part of first portion 552*b* and through or adjacent part of second portion 554*b*, thus facilitating pivotal movement therebetween. Additionally, a first portion 562*b* of each living hinge 560*b* is mechanically engaged (e.g. affixed) to first slat 122*a* of track 120, and a second portion 564*b* of each living hinge 560*b* is mechanically engaged (e.g., affixed) to second slat 122*b* of track 120. A central portion 566*b* of each living hinge 560*b* interconnects the first portion 562*b* and the second portion 564*b* and facilitates relative lateral movement between first slat 122*a* and second slat 122*b* of track 120.

In this embodiment, the sidewalls 140 are affixed to the track 120, thus the use of hinge mechanisms 550*a* and/or living hinges 560*a* enables the width "w" between adjacent sidewalls 140 to be changed between a first, small size to a second, large size. Further, it is envisioned that hinge mechanism 550*a* provides the ability to change between two distinct, discrete widths "w." It is envisioned that the width "w" between adjacent sidewalls 140 is adjustable from between about 2.625 inches (about 6.73 cm), which is the width of a typical 12-ounce beverage container (e.g., a can), and about 2.875 inches (about 7.30 cm), which is the width of a typical 20-ounce beverage container (e.g., a bottle).

To increase the width "w," a user may hold one sidewall 140 or section of track 120 and move it laterally (or sideways) away from an adjacent sidewall 140. To decrease the width "w," a user may hold one sidewall 140 or section of track 120 and move it laterally (or sideways) toward an adjacent sidewall 140.

Figure 7:
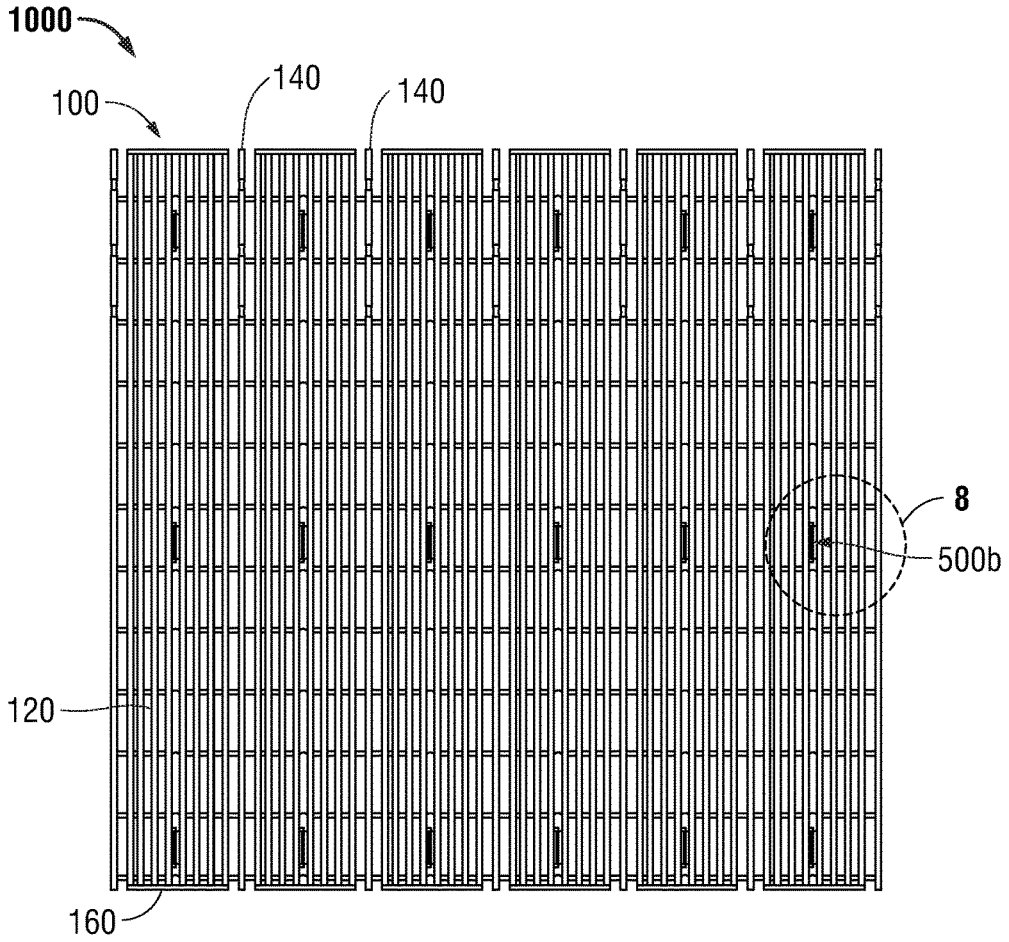
FIG. 7 is a top view of a product display assembly including a second width adjustment feature in accordance with the present disclosure.
Figure 8:
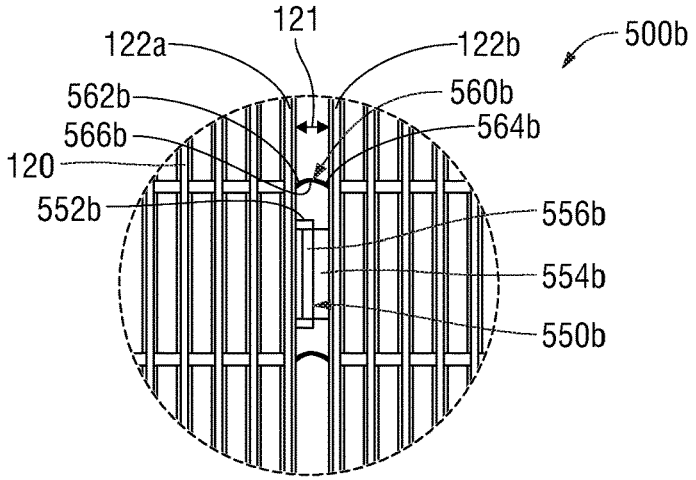
FIG. 8 is an enlarged view of the area of detail indicated in FIG. 7.
Figure 9:
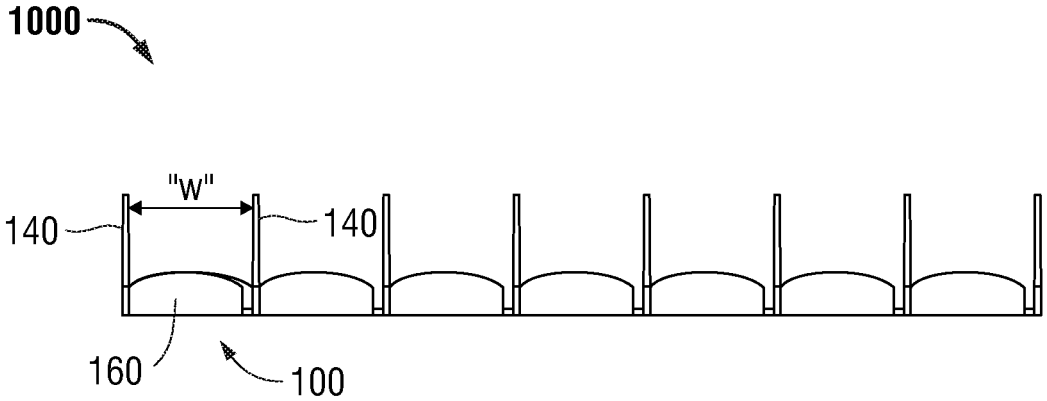
FIG. 9 is a front view of the product display assembly of FIG. 7.

Further, the embodiment shown in FIGS. 7-10 includes one living hinge 560*a* disposed proximally of each hinge mechanism 550*a*, and one living hinge 560*a* disposed distally of each hinge mechanism 550*a*. Other arrangements of hinge mechanisms 550*a* and living hinges 560*a* are contemplated, including the use of hinge mechanisms 550*a* without any living hinges 560*a*. Additionally, while a particular number of hinge mechanisms 550*a* and living hinges 560*a* are shown in FIG. 7, it is envisioned that more or fewer hinge mechanisms 550*a* and living hinges 560*a* are used. Additionally, while hinge mechanisms 550*a* and living hinges 560*a* are shown on each product display unit 100 in FIG. 7, it is envisioned that any number of product display units 100 of product display assembly 1000 includes hinge mechanisms 550*a* and/or living hinges 560*a*.

Figure 10:
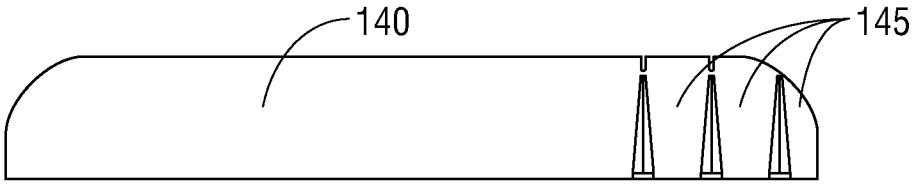
FIG. 10 is a side view of a sidewall of the product display assembly of FIG. 7.

It is further disclosed that removable portion(s) 145 of each sidewall 140 can be removed from the remainder of the sidewall 140 (e.g., by breaking off removable portion(s) 145). In FIGS. 1 and 2, for example, each distal removable portion 145 of each sidewall 140 includes grooves 142, 144 for engaging distal member 180. In FIG. 10, for example, sidewall 140 includes a plurality of removable portions 145. Removal of removable portion(s) 145 enables the length of product display units 100 to be shortened.

Further, while the accompanying figures illustrate a particular number of product display units 100 disposed adjacent each other, it is envisioned and within the scope of the present disclosure to include more or fewer amounts of product display units 100, and to include product display units 100 of other sizes, and disposed at different angles than those illustrated, for example.

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display unit, comprising:

a track defining a longitudinal axis and configured to support a plurality of products thereon;

a first sidewall disposed adjacent the track and disposed above the track;

a second sidewall disposed adjacent the track and disposed above the track;

a distal member disposed above the track and in mechanical cooperation with the first sidewall and the second sidewall, wherein the distal member is slidable with respect to the first sidewall;

a width adjustment feature disposed in mechanical cooperation with the first sidewall, wherein the width adjustment feature enables a distance between the first sidewall and the second sidewall to be changed, wherein the distance is perpendicular to the longitudinal axis, wherein the first sidewall includes at least two removable portions, each removable portion including a first groove configured to slidably engage a first guide of the distal member in a direction that is perpendicular to the longitudinal axis, and a second groove configured to slidably engage a second guide of the distal member in a direction that is perpendicular to the longitudinal axis, and each removable portion is configured to selectively engage the distal member; and a base, wherein the track is positioned on the base, and wherein the width adjustment feature includes a plurality of living hinges engaged with the base.

2. The product display unit according to claim 1, wherein the width adjustment feature is free from contact with the track.

3. The product display unit according to claim 1, wherein the width adjustment feature is affixed to the track.

4. The product display unit according to claim 1, wherein the width adjustment feature includes a plurality of living hinges.

5. The product display unit according to claim 1, wherein the distance is adjustable between about 2.0 inches and about 3.5 inches.

6. The product display unit according to claim 1, wherein the first sidewall and the second sidewall extend from the base.

7. A product display assembly, comprising:

a first product display unit including:

a track configured to support a plurality of products thereon;

a first sidewall disposed adjacent the track and disposed above the track; and a second product display unit including:

a track defining a longitudinal axis and configured to support a plurality of products thereon;

a first sidewall disposed adjacent the track and disposed above the track;

a distal member disposed above the track and in mechanical cooperation with the first sidewall of the first product display unit and the first sidewall of the second product display unit, wherein the distal member is slidable with respect to the first sidewall of the first product display unit;

a width adjustment feature configured to change a distance between the first sidewall of the first product display unit and the first sidewall of the second product display unit, wherein the distance is perpendicular to the longitudinal axis, wherein the first sidewall of the first product display unit includes at least two removable portions, each removable portion including a first groove configured to slidably engage a first guide of the distal member between a plurality of non-discrete positions, and a second groove configured to slidably engage a second guide of the distal member between a plurality of non-discrete positions, and each removable portion is configured to selectively engage the distal member; and wherein the second product display unit includes a base, wherein the track of the second product display unit is positioned on the base, and wherein the width adjustment feature includes a plurality of living hinges connected to the base.

8. The product display assembly according to claim 7, wherein the width adjustment feature is free from contact with the track of the second product display unit.

9. The product display assembly according to claim 7, wherein the width adjustment feature is affixed to the track of the second product display unit.

10. The product display assembly according to claim 7, wherein the width adjustment feature includes a plurality of living hinges.

11. The product display assembly according to claim 7, wherein the distance is adjustable between about 2.0 inches and about 3.5 inches.

12. The product display assembly according to claim 7, wherein the first sidewall of the second product display unit extends from the base.

13. The product display assembly according to claim 7, wherein the first sidewall of the second product display unit is slidable with respect to the distal member.

14. The product display assembly according to claim 7, wherein the first sidewall of the first product display unit defines a length along the longitudinal axis, and wherein the length of the first sidewall of the first product display unit is adjustable.

15. The product display unit according to claim 1, wherein at least a portion of the distal member is disposed distally of a distal-most end of the first sidewall.

16. The product display assembly according to claim 7, wherein at least a portion of the distal member is disposed distally of a distal-most end of the first sidewall of the first product display unit.

17. The product display unit according to claim 1, wherein the first guide of the distal member is arcuate.

18. The product display unit according to claim 17, wherein the second guide of the distal member is arcuate.

19. The product display assembly according to claim 7, wherein the first guide of the distal member and the second guide of the distal member are spaced from an upper edge of the distal member.

* * * * *